US007119773B2

(12) United States Patent
Kim

(10) Patent No.: US 7,119,773 B2
(45) Date of Patent: Oct. 10, 2006

(54) APPARATUS AND METHOD FOR CONTROLLING GRAY LEVEL FOR DISPLAY PANEL

(75) Inventor: Hak Su Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 26 days.

(21) Appl. No.: 09/798,718

(22) Filed: Mar. 2, 2001

(65) Prior Publication Data

US 2001/0019319 A1 Sep. 6, 2001

(30) Foreign Application Priority Data

Mar. 6, 2000 (KR) ..... 2000-11057

(51) Int. Cl.
*G09G 3/36* (2006.01)
*G09G 3/18* (2006.01)

(52) U.S. Cl. ..... 345/89; 345/63; 345/77

(58) Field of Classification Search ..... 345/63, 345/77, 581, 589, 596–600, 605, 89–109, 345/690–699, 204–214; 315/169.1, 169.2, 315/169.3, 169.4
See application file for complete search history.

(56) References Cited

U.S. PATENT DOCUMENTS 3,751,987 A * 8/1973 Whitmore ..... 73/465
4,199,697 A * 4/1980 Edwards ..... 332/115
4,338,598 A * 7/1982 Ohba et al. ..... 345/76
4,366,504 A * 12/1982 Kanatani ..... 348/800
4,698,744 A * 10/1987 Itani et al. ..... 700/12
5,061,880 A * 10/1991 Hashiguchi et al. ..... 315/366
5,122,791 A * 6/1992 Gibbons et al. ..... 345/102
5,652,600 A * 7/1997 Khormaei et al. ..... 345/76
5,671,003 A * 9/1997 Herczeg et al. ..... 347/251
5,701,134 A * 12/1997 Lambert et al. ..... 345/74.1
5,757,348 A * 5/1998 Handschy et al. ..... 345/89
5,831,588 A * 11/1998 Hotto ..... 345/100
5,969,579 A * 10/1999 Hartke et al. ..... 332/116
6,023,259 A * 2/2000 Howard et al. ..... 345/76

FOREIGN PATENT DOCUMENTS

EP 0 942 407 A1 9/1999
EP 1030285 8/2000
JP 54012227 A * 1/1979
JP 11052917 A * 2/1999
JP 2000235370 A * 8/2000
WO WO 99/42983 8/1999
WO WO 99/42983 * 9/1999
WO WO 00/51103 8/2000

* cited by examiner

*Primary Examiner*—Sumati Lefkowitz
*Assistant Examiner*—Alecia D. Nelson
(74) *Attorney, Agent, or Firm*—Lee, Hong, Degerman, Kang & Schmadeka

(57) ABSTRACT

An apparatus and method for controlling a gray level for a display panel driven by a plurality of scan line signals and a plurality of data line signals is characterized in that some bits of the respective data are pulse amplitude modulated and the other bits are pulse width modulated (PWM) so as to control the gray level for the display panel.

4 Claims, 3 Drawing Sheets

APPARATUS AND METHOD FOR CONTROLLING GRAY LEVEL FOR DISPLAY PANEL

BACKGROUND OF THE INVENTION

1. Field of the Invention

The present invention relates to an apparatus and method for controlling a gray level for a display panel.

2. Description of the Related Art

With recent tendency of large sized display devices, request of flat display panels occupied by a small space is increasing. As one example of the flat display panels, an organic EL display panel is receiving much attention. The organic EL display panel is very thin and can be fabricated in a matrix arrangement. Also, the organic EL display panel can be driven at a low voltage of 15V or less.

Recently, an active driving method is mainly used in the organic EL display panel. That is, in the active driving method, charges are stored in a capacitor using a low current and a driving transistor is driven using the charges of the capacitor.

In the active driving method, a gray level for a display panel is controlled by controlling the range of a driving current. However, since the range of the driving current is very small within several hundred pA to several tens of nA, it is difficult to control the gray level for the display panel by appropriately controlling the driving current.

Also, since the very small driving current is used, a charge storage capacitor requires a value of very small capacity. However, there is a limitation in reducing the size of the capacity of the charge storage capacitor due to leakage generated by a switching transistor of the organic EL display panel.

In other words, if leakage current generated by the switching transistor is great, the capacitor requires a greater capacity than the leakage amount to set a desired gray level in the display panel.

However, problems arise in that the pixel size of the display panel is limited and the size of the capacitor is also limited by the limited pixel size. To solve such problems, it is necessary to increase the pixel size or minimize the leakage current. However, it is general tendency that efforts for forming a small sized pixel are in progress, and there is still a limitation in reducing the leakage current.

SUMMARY OF THE INVENTION

To solve the above problems, an object of the present invention is to provide an apparatus and method for controlling a gray level for a display panel, in which the gray level of the display panel is easily controlled based on an active driving circuit having a simple structure.

To achieve the above object, a method for controlling a gray level for a display panel driven by a plurality of scan line signals and a plurality of data line signals according to the present invention is characterized in that some bits of the respective data are pulse amplitude modulated and the other bits are pulse width modulated (PWM) so as to control the gray level for the display panel.

In another aspect of the present invention, a method for controlling a gray level for a display panel driven by a plurality of scan line signals and a plurality of data line signals includes the steps of a) externally inputting a data value corresponding to the gray level for the display panel, b) dividing the input data value into bits of first and second groups, c) either pulse width modulating the bits of the second group after pulse amplitude modulating the bits of the first group or pulse amplitude modulating the bits of the second group after pulse width modulating the bits of the first group, and d) inputting the modulated data to a corresponding data line to control the gray level of the display panel.

In other aspect of the present invention, an apparatus for controlling a gray level for a display panel driven by a plurality of scan line signals and a plurality of data line signals includes a pulse modulation part for pulse amplitude modulating some of bits of externally input data corresponding to the gray level for the display panel and pulse width modulating the other bits to apply them to the data lines, a switch part for switching the pulse modulated data of the data lines in accordance with the scan line signals, and a drive part for controlling the gray level for the display panel corresponding to the data applied from the switch part to drive the display panel.

In the preferred embodiment of the present invention, the pulse modulation part includes a control part for dividing the input data into bits of first and second groups, a pulse amplitude modulation part for pulse amplitude modulating the bits of the first group among the bits divided by the control part, and a pulse width modulation part for pulse width modulating the bits of the second group among the bits divided by the control part.

In the preferred embodiment of the present invention, a driving waveform is divided into a number of short pulses to control them and at the same time control a current within the respective pulses.

It is to be understood that both the foregoing general description and the following detailed description are exemplary and explanatory and are intended to provide further explanation of the invention as claimed.

BRIEF DESCRIPTION OF THE DRAWINGS

Other objects, characteristic features and advantages of the present invention will now become apparent with a detailed description of an embodiment made with reference to the accompanying drawings, in which.

DETAILED DESCRIPTION OF THE PREFERRED EMBODIMENTS

The following is a detailed description of a preferred embodiment of an active driving circuit for a display panel according to the present invention made with reference to the accompanying drawings.

Figure 1:
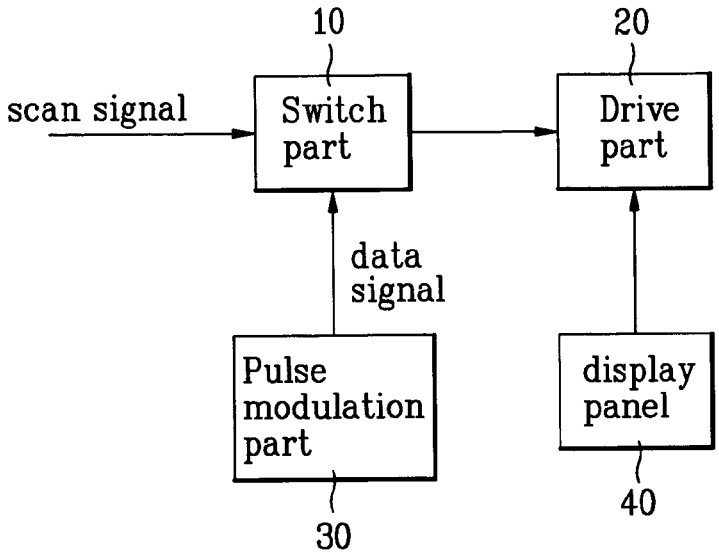
FIG. 1 is a block diagram showing an apparatus for controlling a gray panel for a display panel according to the present invention.

FIG. 1 is a block diagram showing an apparatus for controlling a gray panel for a display panel according to the present invention.

Referring to FIG. 1, the apparatus for controlling a gray level for a display panel driven according to the present invention includes a pulse modulation part 30 for pulse amplitude modulating some of bits of externally input data corresponding to the gray level for the display panel and pulse width modulating the other bits to apply them to data lines, a switch part 10 for switching the pulse modulated data of the data lines in accordance with scan line signals, and a drive part 20 for controlling the gray level for the display panel corresponding to the data applied from the switch part 10.

The aforementioned apparatus for controlling a gray level for a display panel will now be described in more detail with reference to FIG. 2.

Figure 2:
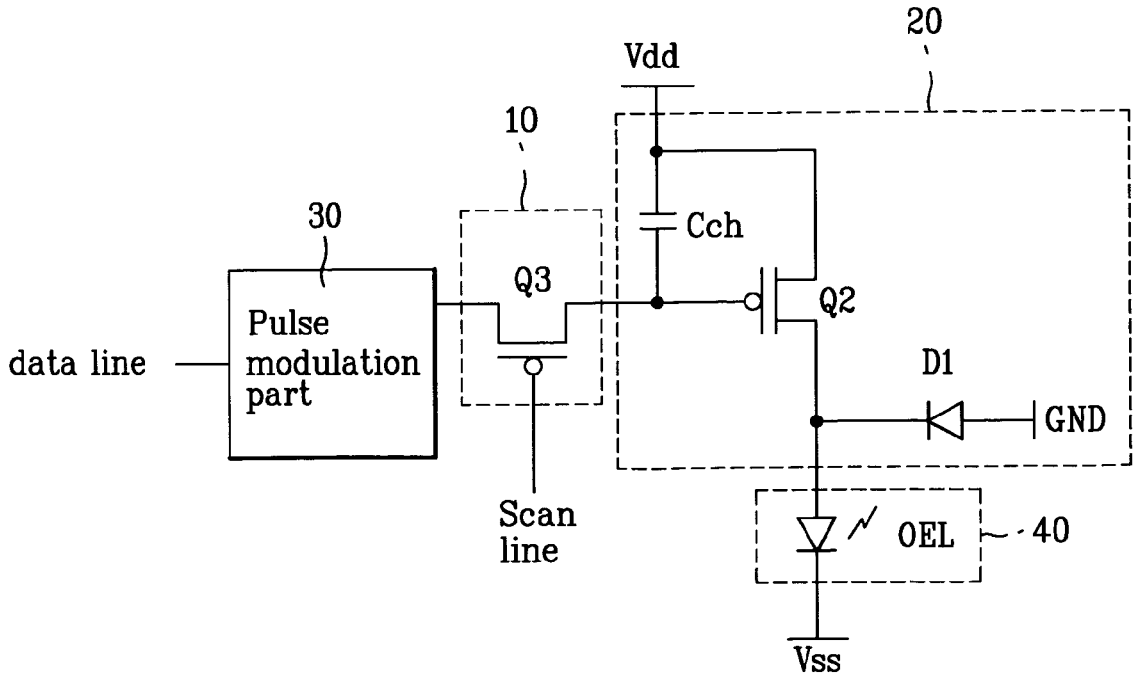
FIG. 2 is a detailed circuit showing an apparatus for controlling a gray panel for a display panel according to the present invention.

Referring to FIG. 2, the drive part 20 includes a charge storage capacitor Cch connected with a positive power source Vdd, and a driving transistor Q2 for applying charges accumulated in the capacitor as much as a difference value between the data line signal and the positive power source Vdd to the display panel so as to drive the display panel. The switch part 10 includes a switching transistor Q3 for switching the data line signals using the scan line signals.

At this time, the positive power source Vdd is connected with a driving transistor Q2 and the charge storage capacitor Cch is connected between the positive power source Vdd and the driving transistor Q2.

The driving transistor Q3 is connected with the driving transistor Q2 and the pulse modulation part 30.

A diode D1 for protecting a voltage is additionally provided. The diode D1 is connected in parallel between the driving transistor Q2 and the display panel to prevent error operation and voltage breakdown of the driving transistor Q2 resulting from voltage drop of the driving transistor Q2.

Figure 3:
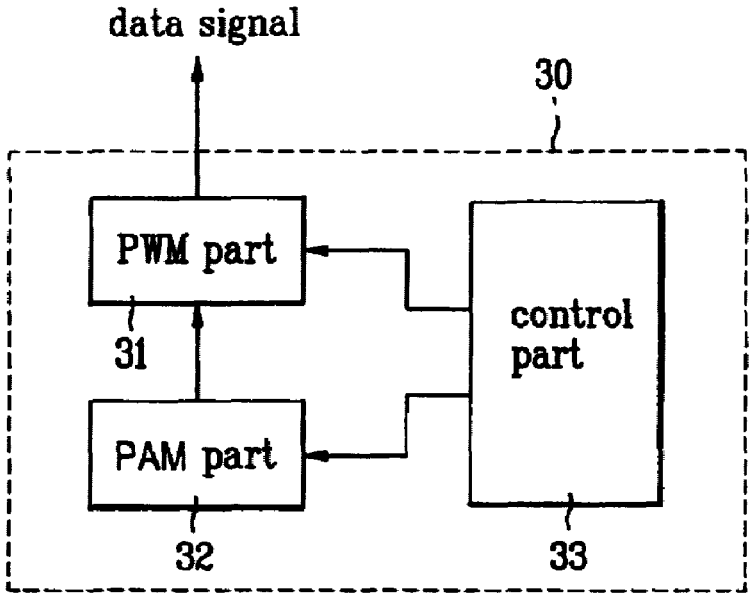
FIG. 3 is a block diagram showing a pulse modulation part according to the present invention.
Figure 4:
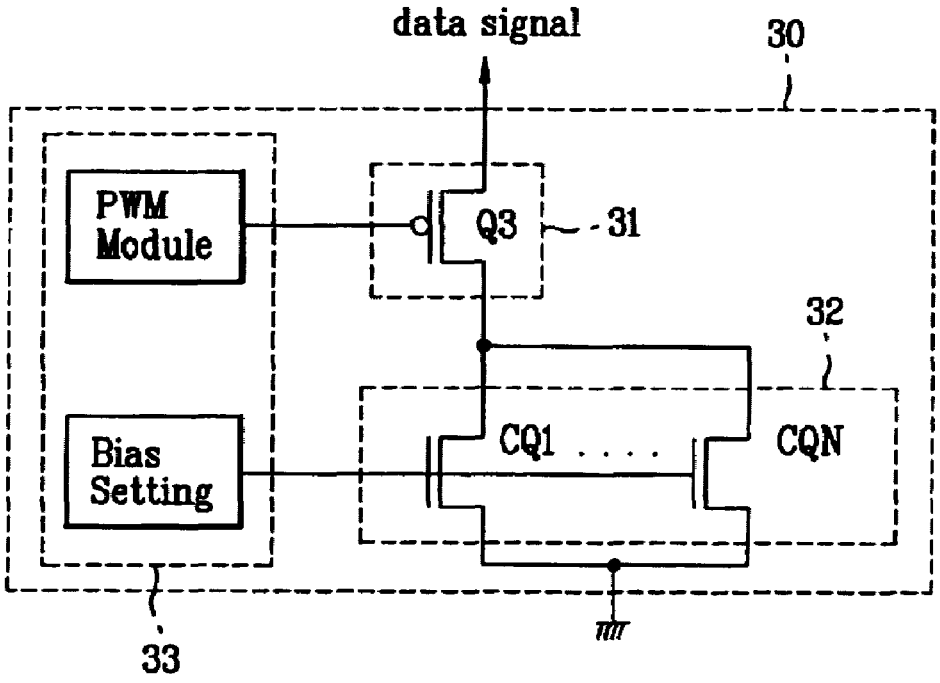
FIG. 4 is a detailed block showing a driving waveform of a display panel according to the present invention.

As shown in FIGS. 3 and 4, the pulse modulation part 30 includes a control part 33 for dividing the input data into bits of first and second groups, a pulse amplitude modulation part 32 for pulse amplitude modulating the bits of the first group among the bits divided by the control part 33, and a pulse width modulation part 31 for pulse width modulating the bits of the second group among the bits divided by the control part 33.

The operation of the aforementioned apparatus for controlling a gray level for a display panel will be described below.

First, if a data value corresponding to the gray level for the display panel is externally input, the control part 33 divides the input data value into the bits of the first and second groups.

The input data value is divided into two groups depending on conditions of the panel or design conditions of the driving circuit.

For example, if the input data value is 8 bits, it is divided into four high bits and four low bits, or arbitrary bits are selected to be divided into two groups.

Subsequently, the bits of the first group among the divided bits are pulse amplitude modulated and then the bits of the second group are pulse width modulated. Alternatively, the bits of the first group are pulse width modulated and then the bits of the second group are pulse amplitude modulated.

CQ1 to CQN of the pulse amplitude modulation part 32 shown in FIG. 4 are generated as much as the number of bits used to control the amount of total current, and pulse amplitude modulate the bits selected by the control part.

Q3 of the pulse width modulation part 31 pulse width modulates a pulse of the respective bits except for the pulse amplitude modulated bits and maintains the pulse for a set time at high level.

As described above, the data pulse modulated by the pulse modulation part 30 are applied to the data lines, a voltage corresponding to the data is input to the charge storage capacitor Cch and the driving transistor Q2 through the switching transistor Q3.

Then, the gray level for the display panel is controlled in accordance with the pulse modulated data input through the capacitor Cch and the driving transistor Q2.

At this time, the switching transistor Q3 is controlled by the scan lines.

As described above, in each pixel, the gray level is controlled under the control of the data and scan lines, and each pixel having the controlled gray level displays one image.

At this time, the scan lines have a sinusoidal waveform equal to the pulse width modulated and applied to the data line.

In the present invention, since the bits of the data are divided and then pulse amplitude modulated or pulse width modulated, the gray level for the display panel has a great width. This facilitates control of the gray level and thus can finely control the gray level.

Figure 5:
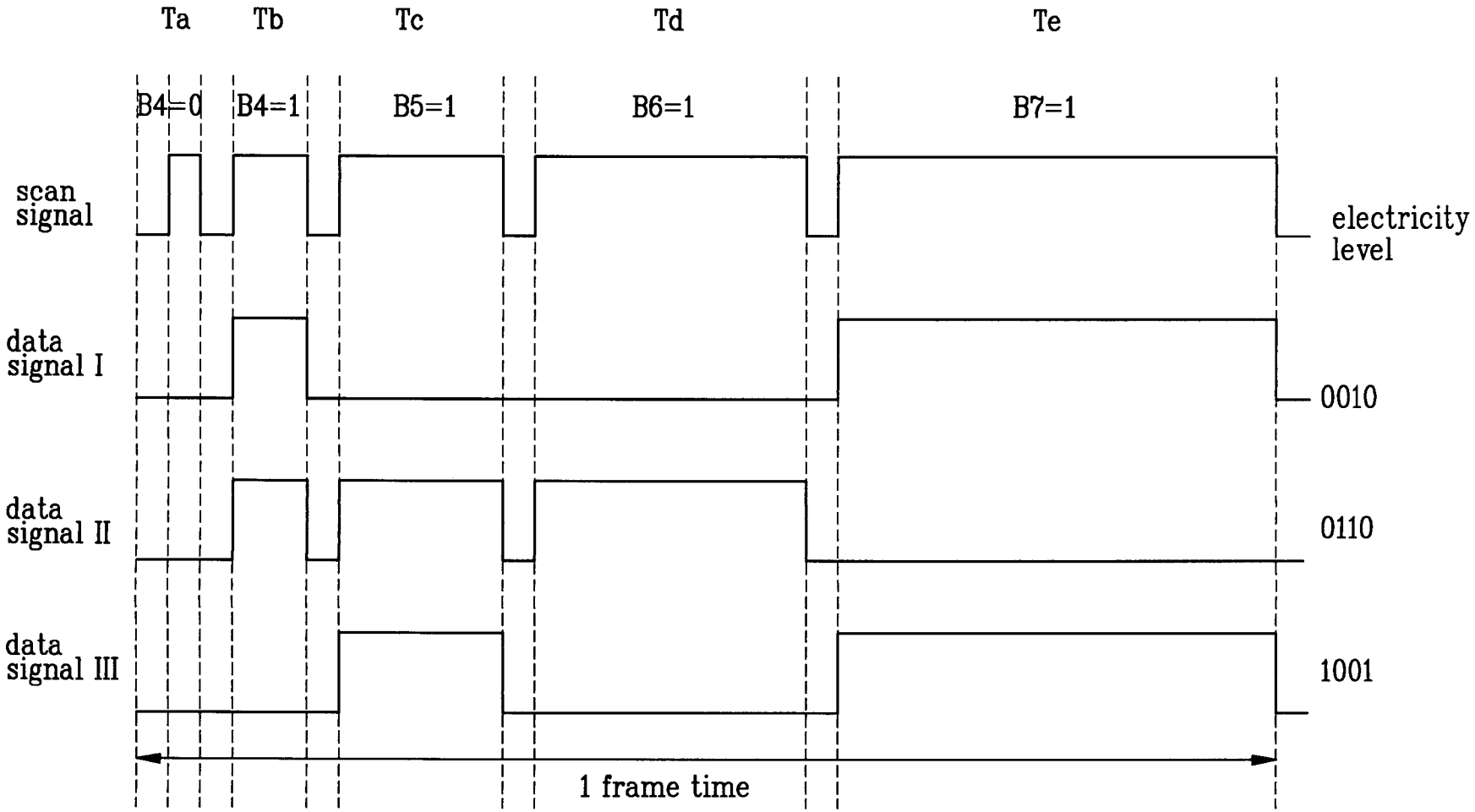
FIG. 5 is a timing chart showing driving waveforms of a display panel according to the present invention.

FIG. 5 is a timing chart showing a driving waveform for a display panel according to the present invention.

Supposing that the data bit applied to the display panel is 8 bits, 8 bits have been conventionally used to control the intensity of current. However, four low bits are only used to control the intensity of current in the present invention. The other four high bits vary the pulse width to control driving time.

While the data signal has been divided into four low bits and four high bits, the data signal may be divided into even bits and odd bits. The data signal may variously be divided depending on designs.

In the present invention, as shown in FIG. 5, the data signal is divided into four levels as follows.

Data signal I: 1001 0010

Data signal II: 0111 0110

Data signal III: 1010 1001.

Supposing that the data signals I, II, and III are as above, FIG. 5 shows how respective waveforms are varied.

At this time, the four low bits show current level while the four high bits show pulses having different pulses at Te, Td, Tc, and Tb in sequence.

Unlike the present invention, if the data pulse is not modulated after dividing the data, the following problems may occur. That is, it is assumed that the current level is 300 pA when the data is "0000 0001" and the current level is 100 nA when the data is "1111 1111." In this case, the gray level for the display panel shows 256 levels based on data of 8 bits. Since the minimum level that can be identified by a human body is about 300 pA, the minimum current level is defined as about 300 pA. The maximum current level for the maximum gray level is defined as about 100 nA.

Therefore, if the data pulse is not modulated after dividing the data, the current level has a current range of about 389 pA ((100 nA−300 pA)/256=389 pA).

In other words, since the current range is small, it is difficult to control 256 gray levels within a small current range. Also, it is more difficult to control the gray levels if leakage current occurs.

However, in the present invention, if the data pulse is modulated after dividing the data, the current range becomes great, thereby facilitating control of the gray levels. That is, one frame time is divided at a proper ratio using four high bits among data of 8 bits. The intensity of the current is controlled using four low bits that show a current level.

In the present invention, since four bits are only used, the current level is 50 nA when the data is "0001" while the current level is 100 nA when the data is "1111".

As described above, supposing that the minimum gray level for the display panel requires the current of about 300 pA when the data of 8 bits is used, the minimum gray level for the display panel requires the current of about 50 nA and the maximum gray level requires the current of about 100 nA when the data of 4 bits is used in the present invention.

Thus, the current level of the present invention has a current range of about 3 nA (100 nA−50 nA)/16=3 nA.

As described above, the current range is about 389 pA when the data is 8 bits while the current range is five times equivalent to about 3 nA when the data is 4 bits. Therefore, it is easy to control the current and a problem related to leakage current can be solved.

In the present invention, as shown in FIG. 5, the current range of four low bits that show a current level is 1 μA, the intensity of the minimum current is 1 μA, and the intensity of the maximum current is 15 μm. Also, the range of the pulse widths of the four high bits is defined as 1, 2, 4, 8 μs.

In case of the data signal I, since the intensity of the current is 2 μA when four high bits 0010 and four high bits 1001 correspond to 9 μs, 2 μA is applied to the display panel for 9 μs, thereby light-emitting the display panel.

In case of the data signal II, since the intensity of the current is 6 μA when four low bits 0111 and four high bits 0110 correspond to 7 μs, 6 μA is applied to the display panel for 7 μs, thereby light-emitting the display panel.

In case of the data signal III, since the intensity of the current is 9 μA when four low bits 1001 and four high bits 1010 correspond to 10 μs, 9 μA is applied to the display panel for 10 μs, thereby light-emitting the display panel.

Meanwhile, the switching time of the switching transistor Q3 becomes longer if the data pulse width applied through the data line is great.

Brightness of the display panel becomes high if applying time of the current to the display panel becomes long.

Accordingly, in the present invention, brightness of the display panel can be controlled by controlling the size of the data pulse width even if the driving transistor Q2 or the storage capacitor Cch is used in the same manner as the related art.

The pulse width from Ta to Te shown in FIG. 5 can be obtained as follows.

Supposing that a frame T is 60 μs and the distance between the respective pulse time is set at about 1 μs, the pulse time is 55 μs.

The size of the current controlled by the data line is in close relation with the pulse size.

In other words, brightness of the display panel when the maximum current occurs in Ta becomes darker than that when the minimum current occurs in Tb.

As described above, the intensity of the current and brightness according to the respective time can be obtained by the process for fabricating the display panel. The size of each time should be satisfied with the following conditions.

$$0\mu s < Ta \leqq Tb \leqq Tc \leqq Td \leqq Te < T\ \text{frame}$$

As above, it is necessary to control the respective pulse width between the respective time of one frame in 0 μs.

In the present invention, the respective time is divided into four levels but can be divided into various levels depending on design conditions of a driving integrated circuit.

As described above, in the present invention, the gray level for the display panel can easily be controlled by the pulse modulation part 30 while the related art active driving circuit is used.

As aforementioned, the apparatus and method for controlling a gray level for a display panel has the following advantages.

The related art active driving circuit that can easily be designed is used and the data applied to the display panel is divided. Some of the data is pulse amplitude modulated to easily control the gray level for the display panel and the other data is pulse width modulated to easily control brightness of the display panel. Also, even if the leakage current is generated, no load of the capacitor size exists, thereby enabling free design.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. An apparatus for controlling brightness of a plurality of light-emitting pixels in a display panel, the apparatus comprising:

a switch for switching bits in a data line according to control information provided by a scan line;

a pulse modulator in communication with the switch for pulse modulating the bits in the data line prior to the bits being switched by the switch, the pulse modulator comprising:

a controller for dividing the data line to first N bits and second N bits;

a pulse amplitude modulator (PAM) for pulse amplitude modulating the first N bits of the data line;

a pulse width modulator (PWM) for pulse width modulating the second N bits of the data line; and a driver for receiving the first N bits of the data line and the second N bits of the data line in response to activation of the switch by the scan line, wherein the driver controls the gray scale of a corresponding pixel based on the first N bits and the second N bits of the data line, wherein the pulse amplitude modulator (PAM) comprises N transistors for respectively pulse amplitude modulating the first N bits of the data line to control current intensity for the corresponding pixel, wherein the current intensity of the corresponding pixel is controlled between approximately 1 μA and 15 μA, and wherein the pulse width modulator (PWM) comprises a switching transistor for pulse width modulating the second N bits of the data line for maintaining the pulse for a set time at a first level to control a drive time for the corresponding pixel, wherein pulse width for the second N bits is between approximately 1 μs and 8 μs, such that gray level for the display panel is controlled between approximately 50 nA and 100 nA.

2. The apparatus of claim 1, wherein the driver comprises:

a power source;

a charge storage medium connected to the power source and the switch, for storing a voltage corresponding to a difference between a voltage applied from the power source and a voltage applied from the switch; and a voltage driver connected to the power source and the charge storage medium for driving the display panel in accordance with the voltage of the charge storage medium.

3. The apparatus of claim 2 further comprising a diode connected in parallel between the voltage driver and a driving pixel of the display panel.

4. The apparatus of claim 2, wherein the charge storage medium is a capacitor.

* * * * *